United States Patent [19]

Shofner

[11] Patent Number: 4,512,060

[45] Date of Patent: Apr. 23, 1985

[54] APPARATUS AND METHODS FOR AEROMECHANICAL AND ELECTRODYNAMIC RELEASE AND SEPARATION OF FOREIGN MATTER FROM FIBER

[75] Inventor: Frederick M. Shofner, Knoxville, Tenn.

[73] Assignee: ppm, Inc., Knoxville, Tenn.

[21] Appl. No.: 552,061

[22] Filed: Nov. 15, 1983

Related U.S. Application Data

[63] Continuation-in-part of Ser. No. 428,608, Sep. 30, 1982, abandoned.

[51] Int. Cl.[3] ..... D01B 3/00

[52] U.S. Cl. ..... 19/200; 19/205

[58] Field of Search ..... 19/200, 204, 205, 105, 19/107, 304–308, 85, 86, 87, 94, 97, 203

[56] References Cited

U.S. PATENT DOCUMENTS

| | | | |
|---|---|---|---|
| 4,135,276 | 1/1979 | Handschuch et al. | 19/200 X |
| 4,223,423 | 9/1980 | Foerster | 19/203 |
| 4,249,244 | 2/1981 | Shofner et al. | 364/525 |
| 4,345,356 | 8/1982 | Handschuch et al. | 19/204 X |
| 4,365,389 | 12/1982 | Beneke et al. | 19/200 |

OTHER PUBLICATIONS

"Standard Test Method for Non-Lint Content of Cotton", Designation: D 2812-81, reprinted from the Annual Book of ASTM Standards, American Society for Testing and Materials, 1916 Race St., Pa., (1981).

J. I. Kotter and D. P. Thibodeaux, "Dust-Trash Removal by the SRRC Tuft-to-Yarn Processing System", Journal of Engineering for Industry, vol. 101, No. 2, pp. 197-204, (May 1979).

F. M. Shofner, W. F. Lalor, J. H. Hanley, "A New Instrument for Microdust and Trash Measurement in Bale or Processed Fiber", presented at The Natural Fibers Textile Conference, Charlott, NC., (Sep. 14–16, 1982), Subsequently published under the revised title, A New Method for Microdust and Trash Measurement in Bale or Processed Fiber, Textile Research Journal, vol. 53, No. 2, (Feb. 1983).

ppm, Inc. Publication, "MTM Operational Overview", Jan. 1983—Preliminary.

*Primary Examiner*—Henry S. Jaudon
*Assistant Examiner*—J. L. Kravitz
*Attorney, Agent, or Firm*—Kerkam, Stowell, Kondracki & Clarke

[57] ABSTRACT

Apparatus and methods for controlled application of aeromechanical and electrodynamic release and separation forces to foreign particulate matter in fiber materials are disclosed. A number of elements are employed in various combinations. One important element is a perforated, pinned cylinder which facilitates foreign particulate matter removal and microdust classification and use of conditioned and controlled airflow for optimum fiber processing and foreign matter removal. Another important element is a counterflow slot. Other important aspects are air blast cleaning of a tenuous mat held onto a perforated cylinder; unidirectional and pulsating airflows to cause repeated engagement of fibers with static cleaning pins and to release additional dust; application of electrostatic release forces to particles bound onto the fiber; and the processing of fiber in properly conditioned inlet air to the machine, as opposed to ambient air. These methods and apparatus enable the design of precise and accurate measurement apparatus for foreign matter in fiber samples. They further provide effective cleaning, blending, and preprocessing of textile fibers for improved measurements of fiber properties. Still further, the invention may be applied to improved fiber cleaning equipment in gins or in textile mills. The invention ultimately permits a simplified spinning apparatus whose input is tufts and whose output is spun yarn.

14 Claims, 10 Drawing Figures

BASIC APPARATUS

BASIC APPARATUS

* INCLUDES RESPIREABLE OSHA COMPONENT 0<AED<15μm

BASIC PARAMETERS OF COUNTER FLOW SLOTS

TYPE C

COMBINATION COUNTERFLOW SLOT

MTM WITH SERPENTINE OPENING-COMBING INPUT

NOTE: CFS COLLECTORS POINT DOWNWARD TO ACHIEVE GRAVITY ASSIST.

MTM WITH HIGH SPEED FEED ROLL/FEED PLATE INPUT

APPARATUS AND METHODS FOR AEROMECHANICAL AND ELECTRODYNAMIC RELEASE AND SEPARATION OF FOREIGN MATTER FROM FIBER

CROSS REFERENCE TO RELATED APPLICATION

This is a continuation-in-part of copending application Ser. No. 428,608 filed Sept. 30, 1982, and now abandoned.

BACKGROUND OF THE INVENTION

The present invention relates to methods and machines for the release and separation of foreign matter from fibers such as cotton. The invention is applicable to two distinct purposes: (1) providing apparatus for precise and accurate laboratory measurement of foreign matter in fiber; and (2) providing apparatus applicable to high production rate fiber processing machinery.

Increasing demands are being placed on fiber properties as textile processing machinery production rates increase and as the tolerances of textile processing machinery for variances in the fiber properties decrease. Current production and harvesting methods inherently entrain more foreign matter content into cotton fiber, for example, such that the ginning and cleaning actions required to achieve a given percentage of foreign matter content are increasing. Increased cleaning is always at the expense of fiber loss and damage. The incompatibility between the goals of clean versus undamaged fiber increases the difficulties faced by producer, ginner, buyer and spinner. Providing clean and undamaged fiber is a major, world-wide problem and new methods of cleaning are urgently needed.

Foreign matter diminishes the value of the fiber because it causes processing problems and because it causes degradations of the yarn. Removal of foreign matter is always at the expense of fiber loss and fiber damage. The designer or operator of cleaning and processing equipment must, using prior art machines, make difficult and economically unattractive trade-offs between cleaning and fiber loss and damage.

Release and separation of foreign matter are important not only in processing applications. In particular, removal of foreign matter is important in instrumentation and measurement applications. Fiber properties are being determined with increasing accuracy, precision, and completeness as a consequence of new instruments for the measurement of four basic properties: length, strength, color, and fineness. Other properties and/or better ways of measuring conventional properties are under investigation. For a detailed discussion, see F. M. Shofner, W. F. Lalor, J. H. Hanley, "A New Instrument for Trash and Microdust Measurement in Raw or Processed Cotton", presented at the Natural Fibers Textile Conference, Charlotte, N.C., Sept. 14, 1982 and published "A New Method for Microdust and Trash Measurement and Bale or Processed Fiber" in *Textile Research Journal,* February 1983, vol. 53, No. 2. Measurements of the above four basic properties have been automated and, with a determination of grade by a human cotton classer, have been assembled into High Volume Instrument (HVI) test lines which are increasingly used by the U.S. Department of Agriculture for setting the class of cotton, which determines its price. Thus grade is primarily influenced by foreign matter content and another urgent need exists to provide this measurement for use on HVI lines.

The present invention is concerned primarily with the bulk fiber property of foreign matter content ("trash", "dust", "microdust", "respirable dust", and the like) in cotton or other fibers, and the effective removal of this foreign matter with low fiber damage and losses. Embodiments of the invention are designated "MTM", Microdust and Trash Machine. (Note: In the above-referenced Shofner et al article, MTM is used as an acronym for Microdust and Trash Monitor.)

Releasing and separating the foreign matter from the cotton permits its more accurate measurement with, for example, modern electro-optic means as described in Shofner et al U.S. Pat. No. 4,249,244. The above-referenced Shofner et al article, as well as FIG. 1 described hereinafter, generally show how electro-optical methods can be used to advantage once the foreign matter is released from the fiber and fiber and various dust components are separated into different pneumatic transport flows.

Prior art apparatus exists which cleans fiber for measurement purposes or for processing. These include the Shirley Analyzer (see "Standard Test Method for Non-Lint Content of Cotton", Designation: D 2812-81, reprinted from the Annual Book of ASTM Standard, Philadelphia, Pa.), as well as conventional lint-cleaning equipment which are generally effective in large particle removal. However, these machines cannot possibly achieve high effectiveness in release and separation of small dust and microdust particles. They damage fiber severely if it is attempted to remove small particles with them.

Of significant importance in the context of measurement is the face that the present invention permits release and separation and according to the following aerodynamic size classifications recently established by the International Committee on Cotton Testing Methods. (Note, AED=Aerodynamic Equivalent Diameter.):

Trash: AED$>$500 $\mu$m
Dust: 50 $\mu$m$<$AED$<$500 $\mu$m
Microdust: 15 $\mu$m$<$AED$<$50 $\mu$m
Respirable Dust: 0 $\mu$m$<$AED$<$15 $\mu$m My colleagues and I have suggested in the above-referenced Shofner et al article that a slightly better terminology is:

Trash: AED$>$500 $\mu$m
Dust: 50 $\mu$m$<$AED$<$500 $\mu$m
Microdust: 0 $\mu$m$<$AED$<$50 $\mu$m thus making OSHA respirable dust a special case of microdust.

SUMMARY OF THE INVENTION

Accordingly, it is an object of the present invention to provide methods and apparatus for release and separation of foreign matter content by the proper application of aeromechanical and electrodynamic forces while minimizing fiber damage or loss.

Another object of the invention is to provide an improved measurement system for the foreign matter content in cotton. The improved measurements result because the forces applied to the particles permit a more effective release and precisely-controlled separation according to aerodynamic size in contrast to prior art devices which are less controlled generally and fail specifically on small particles.

Another object of the invention is to use the fiber thus cleaned and blended and operated upon for improved measurements of the fiber properties themselves. That is, removing the foreign matter and processing the fiber leads to truer fiber property measurements; these data are obviously less biased by the foreign matter and are therefore more accurate. In addition, they are more precise as a consequence of the processing.

A still further object of the invention is application to commercial-scale lint or fiber cleaning, as opposed to laboratory instrumentation application. Lint cleaners in gins can be substantially improved by the principles of the invention. Similarly, textile processing machines such as opening/cleaning, carding, or open-end spinning equipment can produce better (cleaner and less-damaged) outputs. Additionally, losses of good fiber can be reduced.

Yet another object of the invention is application of the apparatus of the invention, in proper combination with well-known pre- and post-processing means, in a total system for conversion of tufts of fiber into yarn with heretofore unknown speeds, quality, and cost-effectiveness. Pre-processing means include opening, pre-cleaning, and transporting fiber to the MTM apparatus. Post-processing means include open-end (or any other type) spinning methods(s) which can take the individualized, cleaned, blended and worked fibers and spin them into high quality yarn.

The invention, reduced to its most basic contributions, provides for application of cleaning (i.e. release and separation) forces heretofore impossible and further provides for heretofore unrealized minimums of fiber loss and damage. A major embodiment is the "counterflow separation slot" which is one thrust of this disclosure.

Briefly stated, apparatus in accordance with the invention comprises what resembles a conventional pinned or toothed cylindrical rotating wheel such as an individualizing and cleaning wheel or a beater wheel. In general, cotton tufts are inserted into the machine to engage the teeth or pins, carried with the wheel part way around, and then removed or doffed as individualized and processed fiber.

Within this overall context, one important aspect of the invention is the provision of perforations on the cylindrical surface of the wheel, and a radial suction port for drawing transport gas through these perforations. The transport gas carries with it microdust, which, in instrumentation applications, can be measured.

Another important aspect of the invention is the provision of counter flow slots oriented generally tangentially with respect to the beater wheel and positioned with respect to the direction of wheel rotation such that dust and trash particles are thrown into the slot. At the same time, transport gas flows in a counter direction. The larger dust and trash particles escape, while microdust and fibers are turned back by the counter flow. In instrumentation applications, the escaping dust and trash can be measured.

Preferably, perforated wheels and counter flow slots are combined in a single machine.

Another important aspect of the invention is the conditioning of the transport gas as to humidity, for example, before entering the machine. Air into the machine can be far more economically and accurately conditioned than the general ambient air in the work place, thus providing fundamental advantages in measurement and processing. Other examples of conditioning the inlet gas stream are according to the parameters of: temperature, pressure, gas composition, free charge concentration (ions), radioactive particle concentration, and velocity and pressure fluctuations.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION

Figure 1:
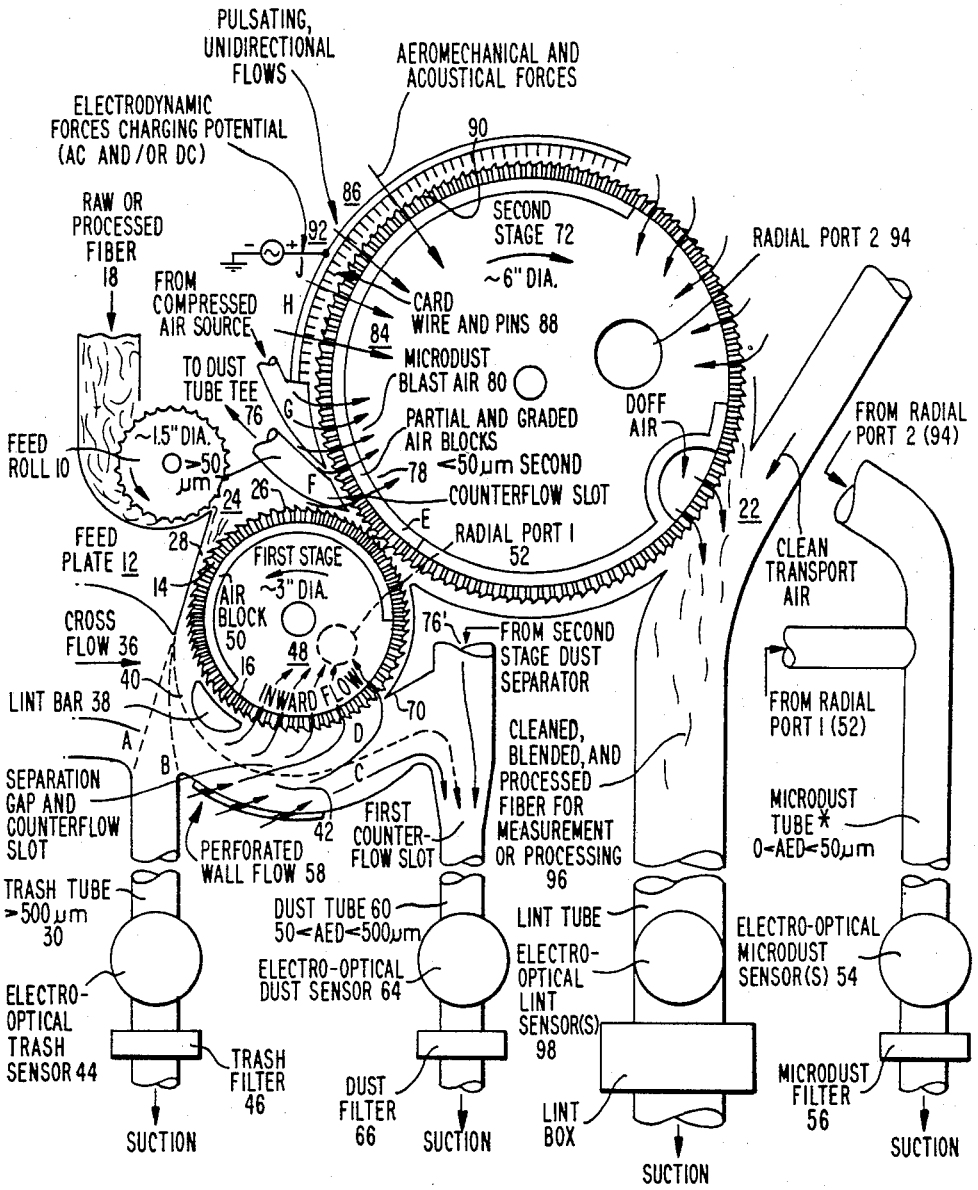
FIG. 1 is a diagrammatic view of a basic two-stage apparatus in accordance with the invention.

Referring first to FIG. 1, a two-stage separation apparatus in accordance with the invention includes a conventional feed roller 10/feed plate 12 arrangement in combination with a toothed first stage individualizing and cleaning wheel or beater 14 of hollow cylindrical configuration. While the wheel 14 is illustrated as having teeth, hardened pins in a helical pattern may alternatively be employed. The rotational speed of the first stage wheel 14 may be in the range of from 50 to 5000 RPM, and is nominally around 3000 RPM. The wheel 14 is roughly similar to the licker-in of a conventional carding machine or the beater stage of an open-end spinning head, with, however, the important exception of perforations 16, which in accordance with the invention, allow flow radially into the wheel 14. Pneumatic or physical transport of raw stock 18 (for example, cotton tufts) into the feed roller 10/feed plate 12 is accomplished by any of a number of conventional techniques, for example, by a condenser arrangement.

From the first stage wheel 14, fiber is transferred as at point E to a rotating second stage wheel 72 by toothed- or pinned-wheel transfer or pneumatic "doffing", or both. Finally, the fiber is removed or "doffed" as at 22 from the second stage for subsequent measurement or processing. The various transfers briefly summarized above are, in general, well known in the art.

Having generally described the manner in which cotton tufts are inserted into the FIG. 1 machine and individualized, cleaned, and processed fibers are removed from the machine, described now in detail are the methods of proper application of aeromechanical and electrodynamic forces in accordance with the invention for the controlled release and separation of foreign matter from the fiber. While these methods are described in the context of the two-stage machine of FIG. 1, it should be noted that for some applications a single-stage apparatus is sufficient. The novel features will be seen to be equally advantageous for measurements and for processing.

Tufts of randomly oriented fiber 24 are gripped by the feed roll 10/feed plate 12 combination and engage teeth 26 of the first stage or beater wheel 14. This action combs the fibers 28 and imparts large impact forces preferentially to the large, dense particles in the fiber, striking them toward a trash tube 30 with trajectories between those represented at A and B. The fibers are hooked by the teeth 26 and quickly accelerated to the peripheral speed of the first stage wheel 14 when they are released from the gripped tuft.

Conditioned inlet air 36 or other transport gas is directed toward the beater wheel 14 in a crossflow manner so that particles smaller than, for example, 500 μm aerodynamic equivalent diameter (AED), do not enter the trash tube 30. That is, particles having AED>500 μm are "knocked" across the inlet crossflow 36 into the trash tube 30. Particles having AED<500 μm however move into a separation gap 42. The trajectory lines A and B permit aerodynamic definition of the particle size captured. The lower cut-off, AED=500 μm in this illustration, results from balances between the outward centrifugal and inward aerodynamic drag forces on the particles.

One or more lint bars 38 may be employed to aid in the removal by preferentially holding fibers on the beater wheel 14 and causing more sharply accelerating flow 40 to accelerate trash particles outward into the separation gap 42.

Trash particles thus removed and classified may then be measured by electo-optic 44 or gravimetric 46 means. A suitable electro-optic sensor employs the continuous aerosol monitor (CAM) technique disclosed in Shofner et al U.S. Pat. No. 4,249,244. Modified CAM sensors 44 have proven to measure the total trash mass or weight and to provide particle size classification or mass fraction analysis. These same particles may be captured on filter materials 46 for weighing and, in some cases classification, both using means well known in the art.

At the other extreme, microdust, that is particles smaller than, for example, AED<50 μm, is drawn into the perforated cylinder 14 through the holes 16 by aerodynamic drag forces effected by a radially inward air flow component represented at 48. The inward flow 48 is controlled to preferred circumferential regions by a semi-cylindrical air blocking sleeve 50. The separated microdust is then pneumatically transported through a radial port 1 (52) and thence to an electro-optical 54 or gravimetric 56 weighing means. Suction is applied to the radial port 1 (52) to draw the air or other transport gas through the machine and, in particular, through the perforations 16.

This microdust removal and separation means is both novel and of fundamental importance. Sharply-defined aerodynamic classification results from this application of two opposing forces. Particles which are released are separated because AED>50 μm particles cannot go into the cylinder 14 since their large outward centrifugal force overpowers their inward aerodynamic drag force.

On the other hand, fibers, whose AED's are also <50 μm, do not enter the perforations 16 because of their length. Fiber fragments whose lengths are about the same diameter as the holes do enter and are properly classified as microdust.

This leaves the dust particle class between 50 μm and 50 μm. By proper balance of various design and operating parameters such as cross flow 36, perforated wall flow 58, and the direction and dimensions of the separation gap 42, the particles between 50 μm and 500 μm are separated into the dust tube 60 from which they are pneumatically transported along trajectory C into electro-optical 64 or gravimetric 66 measurement apparatus.

At point D is a separation stripper 70 which defines the final cut in AED for the first stage. It is most important to note, in the vicinity of points C and D, that air is moving into the wheel 14 and into the dust tube 60. Larger particles move outward across or counter to the inward flow 70 and into the dust tube 60. This is one embodiment of the counter flow slot concept described in detail hereinafter with reference to FIGS. 2–6.

It will be appreciated that this apparatus effectively addresses both the requirement for the release of dust from the fiber, and the separation of the dust and the fiber from the system. It is one thing to release dust from the fiber, and quite another to separate it from the system.

In some cases, strong adhesion of the particles necessitates a second, more vigorous or aggressive stage. Careful attention must be paid to the density of fiber (mass per unit area) on the wheels. If the density is high, removal of the foreign matter from the fiber is less effective and fiber damage can result. But low density means low processing rates which results in longer processing times and/or costs. Thus for more effective removal, the second stage provides forces which can be much higher because the fiber has been opened and combed and because the fiber density can be much lower.

Fiber is transferred to the second stage cylindrical wheel 72 at Point E. The peripheral velocity of the second stage cylinders 72 is much higher, and stronger release and separation forces can be applied. (Which, again, are distint forces). In addition, the density of the fiber on the second stage wheel 72 is relatively tenuous compared to the first stage wheel.

A second counterflow slot is placed at point F. While the principles of counterflow slots are described in detail below with reference to FIGS. 2–6, it may here briefly be noted that large (e.g., AED>50 μm) particles removed by impaction and combing and whose momentum overcomes the inward flow drag are separated into the dust tube 76, 76' and combined with the dust from the first stage along the trajectory C.

To aid in microdust release and separation, a source G of blast air 80 is provided at a point between the point E where fiber is transferred to the second stage wheel 72 and the point 22 where the lint mat is doffed. The lint itself does not pass through the perforations, which are typically about 0.060 inch (~1.5 mm) in diameter and provide in the order of 25% open area.

The lint, whose AED<50 μm, is held onto the the cylinder 72 by the inward flows 78 and by the "hook" action of the teeth. Again, the length of the lint precludes its movement through the holes in the perforated wheels, even when the forces are very large, as with the microdust blast air G.

Carding action is employed as at point H, and is commonly recognized as effective in microdust release. Conventional carding machines however do not employ inward flows as at 84, or pulsating (i.e. acoustical) flows for microdust removal, as at 86. As in the case of the first stage, the radially inward flows 78 and 84 are provided by suitable holes between the teeth so that clean air or other transport gas may move first through the external pins 88 ("flats") into the perforated wheel 72.

Between the card pins 88 and wheel teeth 90 mechanical combing, aerodynamic, forces as at 92 are applied to the fiber (and to the dust particles) causing the fiber to more effectively engage the pins and thereby further release microdust.

An exemplary electrodynamic force is provided by a static or DC voltage 92 applied between the pins 88 and the second-stage wheel 72. Alternatively, an alternating voltage in some cases more effectively causes release. In yet other cases, undesirable electro-static forces which render less effective particle release or which cause fiber damage may require change neutralization. This can be accomplished with electrical 92 or radioactive means.

It may be noted that application of electrostatic forces 92 to fibers is heretofore known, but not for the purpose of aiding cleaning and not in combination with the components of the FIG. 1 embodiment.

Microdust thus removed and separated is similarly transported by suction into radial Port 2 (94) and to the microdust sensing means, which may be electro-optic (54) or gravimetric (56).

In brief summary of FIG. 1, in accordance with the invention there is provided a proper combination of various aeromechanical and electrodynamic forces, especially including radially inward, aerodynamic drag forces, for the controlled release and separation of foreign matter from fiber. The separation is into pre-determined aerodynamic equivalent diameter (AED) classifications such as (1) Trash: AED$>$500 $\mu$m; (2) Dust: 50 $\mu$m$<$AED$<$500 $\mu$m; and (3) Microdust: AED$<$50 $\mu$m.

The third of the above classifications, AED$<$50 $\mu$m, in turn includes a subclass, respirable dust, as defined by OSHA, AED$<$15 $\mu$m. This subclass is advantageously further classified by the CAM electro-optical method of U.S. Pat. No. 4,249,244. This CAM method permits E-0 classification of the trash and dust components as well.

The resultant lint removed at 2 by centrifugal or aerodynamic forces has been cleaned, processed and blended. The fibers are generally individualized and are in an ideal state for electro-optical measurement as at 98, or for further processing, as for example, open-end spinning as described in J. I. Kotter, D. P. Thibodeaux, "Dust-Trash Removal by the SRRC Tuft-To-Yarn Processing System", *Journal of Engineering for Industry*, Vol. 101, No. 2, May, 1979. Fiber property measurements are discussed hereinafter.

The apparatus of FIG. 1 embodies a number of basic principles and concepts in accordance with the invention whereby new and properly controlled forces are applied to remove and separate foreign matter from lint. One particularly significant aspect of the invention is the counterflow slot concept mentioned briefly with respect to the FIG. 1 counter flow slots at C and F, and described in detail hereinafter with reference to FIGS. 2–6. In general, the embodiments of FIGS. 2–6 emphasize aeromechanical release and separation.

As the term is employed herein, a counter flow slot is a slot-like conduit or opening wherein flow of different constituents occurs in opposite directions at the same time. In general, air flows in one direction, and the relatively larger dust and trash particles (in contrast to microdust) flow in the opposite direction, i.e., counter to the airflow.

Figure 2:
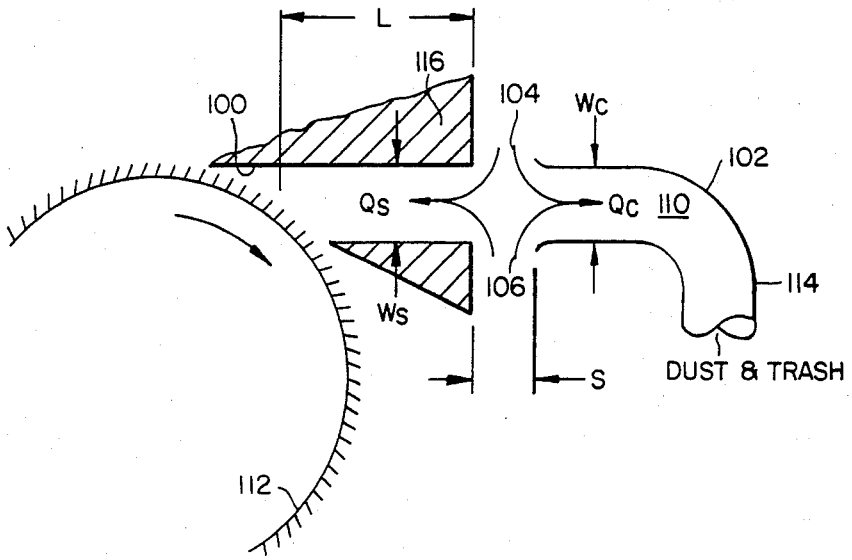
FIG. 2 is a generalized depiction of a counterflow separated slot, defining various paramaters.

FIG. 2 depicts the general structure and defines the basic parameters of counter flow slots. In FIG. 2, the actual counter flow slot into which dust and trash particles are thrown by rotational force of a representative wheel 112 is designated 100. To achieve this result, the slot 100 is oriented generally targentially to the wheel 112 and properly positioned with respect to the direction of rotation of the wheel 112. The slot 100 communicates with a collector tube 102 out of which dust and trash exit at 114. A pair of elongated openings 104 and 106 allow airflow to enter, which branches in two directions to flow in the slot 100 and the collector tube 102. It will be appreciated that this general structure is subject to numerous variations.

In FIG. 2, it will be appreciated that the cross-hatched boundary portions of the slot 100 run parallel to the axis of rotation of the main cylinder 112. The collector tube 102 inlet also runs axially, but its flow $Q_c$ is drawn into a round conduit 114 for the pneumatic transport of the dust plus trash to the disposal or measuring means, as for example, a CAM sensor 44 or 64, as in FIG. 1.

The parameters defined in FIG. 2 are the following:

L=length of the slot 100

$W_s$=width of the slot 100

$W_c$=width of the collector tube 102

S=spacing between slot 100 and collector tube 102

$Q_s$=airflow rate into the slot 100

$Q_c$=airflow rate into collector tube 102

The manner in which action of the slot 100 in combination with a perforated cylindrical wheel perform aerodynamic separation and classification will now be described in greater detail. Fiber and foreign matter particles are thrown into the slot 100 by the rotational force of the cylindrical wheel 112 and move in a sense that is generally counter to the flow of air $Q_s$ into the slot 100. On the other hand, fibers have AED$<$50 $\mu$m, typically, and, along with foreign matter particles having AED$<$50 $\mu$m, are turned around and drawn back toward the cylinder 112 by the airflow $Q_s$. Lint is thus recaptured by the pins or teeth of the cylinder 112 and carried with the cylindrical wheel 112. Small particles are drawn toward the cylinder 112 and, if sufficiently small such that the aerodynamic drag forces overcome the centrifugal acceleration forces, they are drawn inside if it is perforated. As noted above, this is a sharply-defined and easily-controlled aerodynamic classification mechanism and is one of the major aspects of the invention. Large particles, having greater momentum or longer stop distances, also move counter to the incoming slot flow and, if they reach the inlet of the collector tube 102 are thereby caught and transported outward for measurement or simple removal purposes.

It has been found that another major feature of the counterflow slot is elimination of individual lint or fibers leaving the system. This accomplishes a major, heretofore impossible objective: retaining lint particles within the system. Prior art machines necessitated a difficult tradeoff between cleaning efficiency and fiber loss by allowing a certain amount of fiber to be ejected from the system along with the foreign matter. This can be very uneconomical because, in some systems, for each incremental unit weight of foreign matter ejected, a roughly equal unit weight of good fiber is thrown from the system.

It is noted that some fiber will be thrown out of the counterflow slot 100 of FIG. 2 but it is always attached to more aerodynamically massive entities. These components of the fiber are undesirable from processing viewpoints in any event, and include motes, seed coat fragments, and fibers so intimately entwined with foreign matter that they could not be processed.

To restate a major benefit of counter flow slots: good, individualized fiber is not thrown from the slot.

From FIG. 2, it will be appreciated that the designer (and even operator) of fiber cleaning equipment has at his disposal a heretofore unknown range of effective operational parameters with which to adjust the cleaning efficiency of the machine. The slot parameters may be adjusted in combination with the physical dimensions and speeds of the main cylinder 112 to achieve predetermined aerodynamic cut-offs and efficiencies of removal.

The aeromechanical separation principles of the basic counterflow slot of FIG. 2 may be embodied in a number of forms. For convenience, three overall forms are herein designated Type A, Type B and Type C, and illustrated in FIGS. 3A, 3B and 3C, respectively.

Figure 3A:
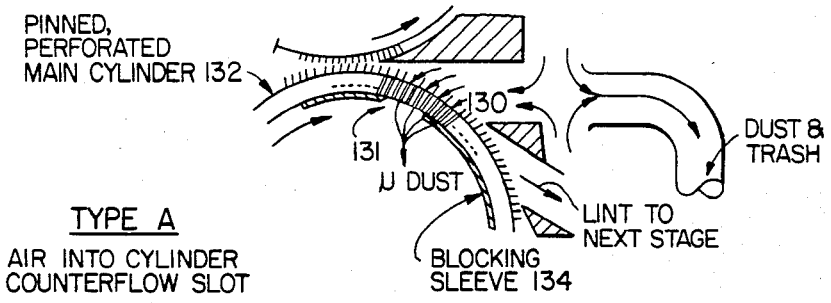
FIGS. 3A, 3B and 3C depict three representative forms of counterflow slots, herein termed "Type A", "Type B", and "Type C" counterflow slots.

In the Type A form of FIG. 3A, air or transport gas is drawn at 130 into a perforated main cylinder 132. The circumferential extent 131 in which slot air 130 flows is defined by a blocking sleeve 134.

Figure 3B:
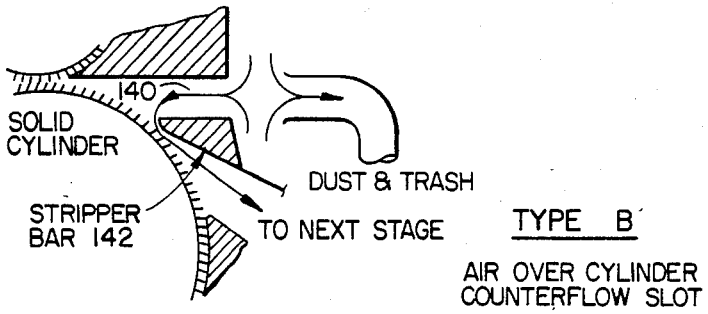

In the Type B form of FIG. 3B, air or transport gas is drawn at 140 into a slot around a stripper bar 142. Both lint and small particles are transported to a subsequent stage whose basic parameters may be adjusted to allow aerodynamic separation cuts which are for smaller particles and which are sharper in their performance. However, unless either a perforated cylinder or perforated wall (as illustrated in FIG. 3C described next is employed), the microdust is not separated from the lint.

Figure 3C:
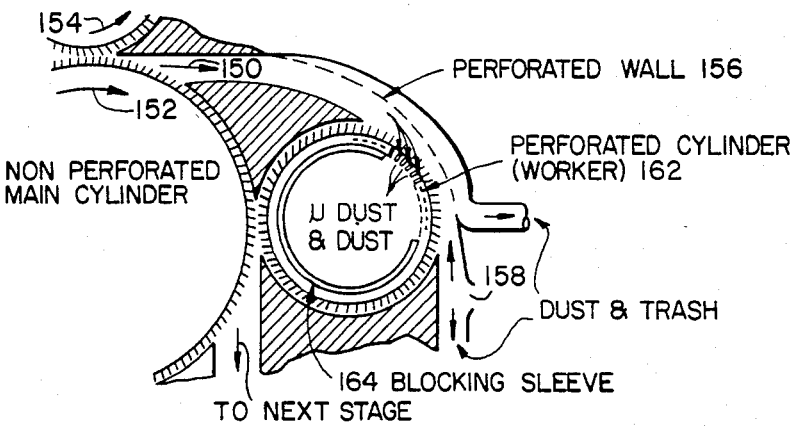

The Type C form illustrated in FIG. 3C results in a construction which is less expensive than the Type A form and about equally effective in the removal of foreign matter. In this case, the lint is pneumatically transported at 150 along with the foreign matter which has been removed by the action of a non-perforated main cylinder 152 in transfer from a feed or input cylinder 154. Particles are then subsequently separated from the lint in three mechanisms in FIG. 3C: (1) through a perforated wall 156 (Recall that the fiber density is low so that the particles have an opportunity to migrate through the tenous fiber mass into the perforated wall.); (2) at the counterflow slot 158 (shown here as a single-entry slot); and (3) microdust and possibly dust into the perforated cylinder 162.

The Type C embodiment of FIG. 3C provides a more econmical construction for at least two major reasons. First, the smaller perforated working cylinder 162 and blocking sleeve 164 are less expensive in their constructions. Second, this adaptation may be retrofitted to a variety of existing lint-cleaning equipment for which perforated main cylinders would be prohibitively expensive and/or unavailable.

It will be appreciated that numerous other configuations of counterflow separation slots are certainly possible, and there is no intention to limit the invention to the specific embodiments illustrated herein.

Figure 4:
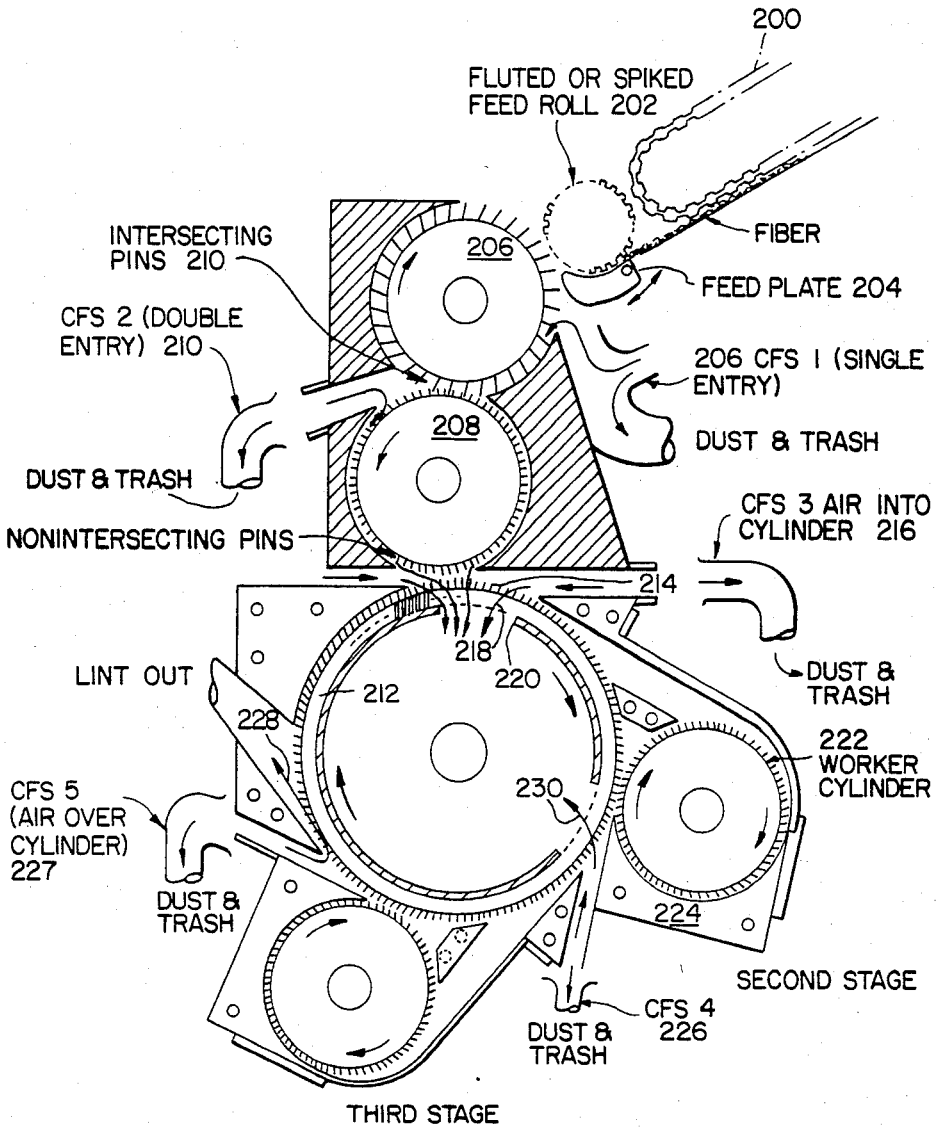
FIG. 4 depicts an aeromechanical separator machine in accordance with the invention, which machine utilizes serpentine feed, employs five counterflow slots, two microdust removal points, and pinned and perforated cylinders.

FIG. 4 illustrates an embodiment of the invention which is constructed of practical elements and which has been thoroughly tested. Fiber is drawn by a belt/-slide arrangement 200 into a conventional feed roll 202/feed plate 204 configuration. A first or opening cylinder 206 combs the fiber around the feed plate 204 and removes foreign matter, preferentially large foreign matter or trash, which is then separated into a first counter flow slot (CFS 1) 206, shown as a single entry slot.

The fiber, which is hooked onto the forward raked pins of the combing cylinder 206 is then transported into an input or feed cylinder 208 having pins 210 which intersect with pins of the combing cylinder 206. The fiber is transported in a serpentine fashion such that both sides of the fiber mat are acted upon or cleaned. The input cylinder 208 is typically moving at a much higher speed than the combing cylinder 206 and foreign matter is aeromechanically released and separated using a second counter flow slot (CFS 2), illustrated as a double-entry slot. The fiber is then transported to a main, high-speed cylinder 212, again in a serpentine fashion. Vigorous aeromechanical separation 214 takes place at the inlet of the counterflow slot 216, shown here as a Type A slot as in FIG. 3A (air into cylinder slot) and provides a third opportunity for removal of foreign matter. In this case dust and trash are thrown out into a third counter flow slot (CFS 3) and microdust is drawn into the perforated cylinder 212 at 218.

The inward drag forces disappear at the beginning of a blocking sleeve 220. The lint is thus removed from the main cylinder 212 and thrown onto a second-stage worker cylinder 222 which then transports the fiber around for a second engagement with the main cylinder 212. The second engagement is not serpentine but is in the form of a high-speed feed roll 222/feed plate 224 combination.

At this point, a fourth counterflow slot (CFS 4) 226 operates also as a Type A air into cylinder slot. Also, microdust is drawn into the perforated main cylinder 212 at 230.

The process is repeated for the third stage with the only difference being that a fifth counter flow slot (CFS 5) 227 is a Type B (air over cylinder). In this case, the air 228 drawn into the slot is also used to pneumaticaly doff and transport the lint out of the system for subsequent processing or measurement use.

It is worth re-emphasizing at this point that the lint thrown out of the machine is individualized and has been cleaned and processed. This fiber is in a preferential state for measurement or further processing.

In summary, FIG. 4 thus illustrates the application of five counterflow slots of various designs in a single machine. In addition, there are two microdust capture points 218, 230 making a total of seven opportunities to remove foreign matter from the lint. It has been determined from extensive experimentation with this apparatus that considerable advantage is realized when multiple opportunities for foreign matter removal are offered. These advantages result in both more complete foreign matter and in less fiber damage and loss.

In the interest of completeness of disclosure, it is reported herein that apparatus having the following basic parameters has proven successful:

| Cylinders | Diameter Inches | Speed RPM | Height Inches | Pins Angle | Density #/in$^2$ | Pattern |
|---|---|---|---|---|---|---|
| Combing | 3 | 10–300 | $\frac{1}{4}$ | 9° | 16 | Circular |
| Inlet | 3 | 60–3000 | $\frac{1}{8}$ | 9° | 50 | Circular |
| Main | 6 | 2000–4000 | $\frac{1}{8}$ | 9° | 100 | Helical |
| Workers | 3 | 50–5000 | $\frac{1}{8}$ | 9° | 50 | Helical |

| Counterflow Slots | $Q_s$ CFM | L in | $W_s$ in | $Q_c$ CFM | $W_c$ in |
|---|---|---|---|---|---|
| 1 | 3 | 3 | $\frac{1}{2}$ | 5 | $\frac{3}{4}$ |
| 2 | 10 | 2 | $\frac{1}{2}$ | 5 | $\frac{3}{4}$ |
| 3 | 25 | $1\frac{1}{2}$ | $\frac{1}{2}$ | 5 | $\frac{3}{4}$ |
| 4 | 15 | $1\frac{1}{2}$ | $\frac{1}{2}$ | 5 | $\frac{3}{4}$ |
| 5 | 35 | 1 | $\frac{3}{4}$ | 5 | 1 |

Two machines in particular have been constructed, respectively having approximately 1-inch and $8\frac{1}{2}$ inch axial extents. The above data are for the $8\frac{1}{2}$ inch machine.

A further comment concerning the use of pins and especially intersecting pins 210 is in order. Conventional, prior art, lint-cleaning equipment uses either teeth 26, as illustrated in FIG. 1, or hardened pins as illustrated on cylinders 206, 208, and 212 in FIG. 4. It has been found that the hardened pin construction offers significant advantages with regard to operating life of the cylinder and with regard to fiber damage.

The intersection of pins 210 between the combing 206 and feed 208 cylinders has been found advantageous for complete fiber transfer between these two cylinders and also because it affords a good opportunity to comb or align the fibers in addition to providing aeromechanical release and separation forces. It is of significance that the fiber fed into the main cylinder is less dense than in prior are machines and furthermore the fibers have been drawn or drafted by the two inlet stages.

Figure 5:
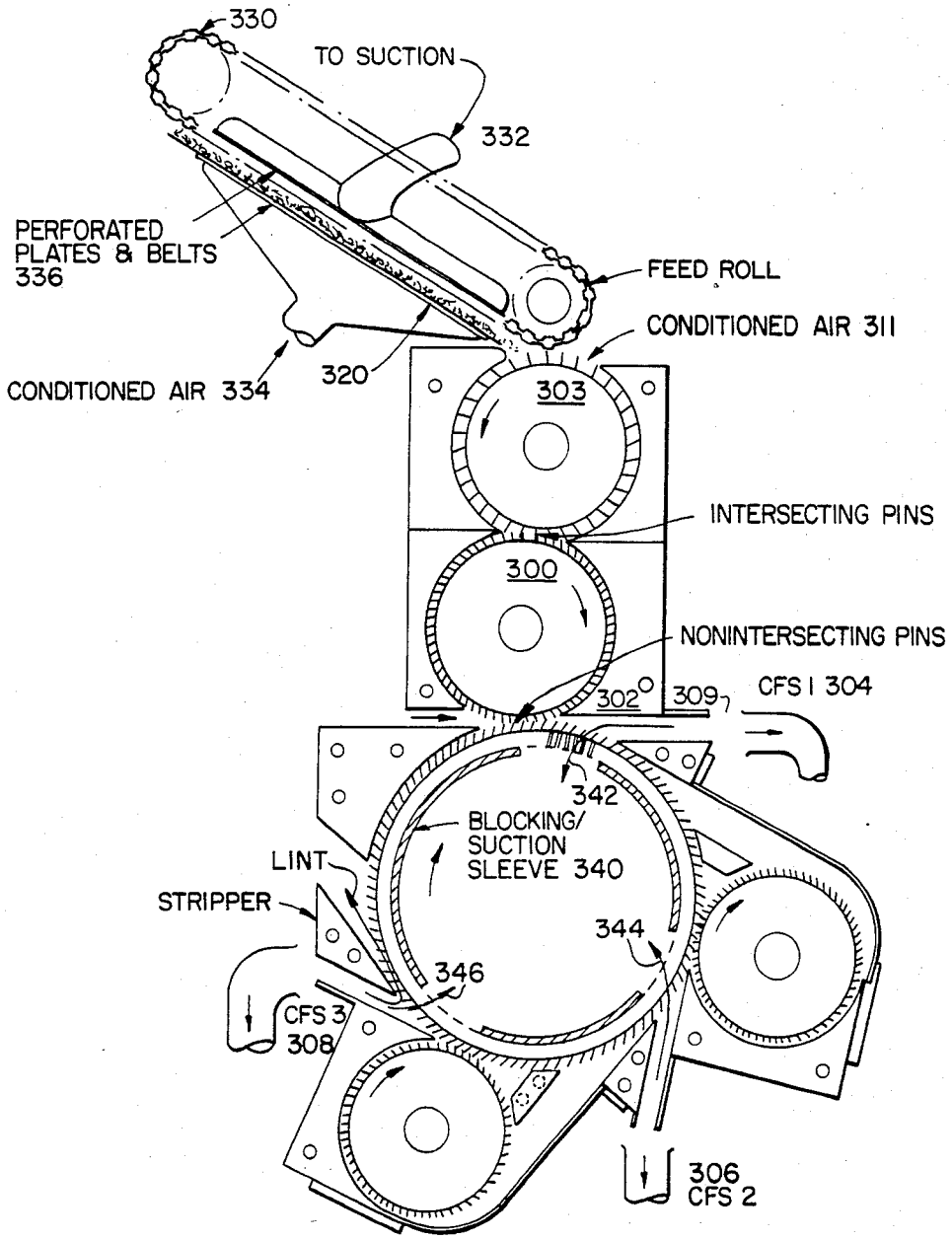
FIG. 5 depicts another machine embodiment in accordance with the invention employing high speed feed roll/feed plate input.

FIG. 5 shows another embodiment using the same aeromechanical separation equipment as for FIG. 4 but using a different feeding arrangment. Rather than the serpentine pattern of FIG. 4, the fiber is fed from the inlet cylinder 300 in a conventional feed roll 300/feed plate 302 arrangement. Fiber is more agressively combed in this manner and in some cases the attendent higher fiber damage rates are acceptable in balance with the improved combing and release and separation of foreign matter. The serpentine pattern is retained for the combing cylinder 303 except that the stock feed roll 202/feed plate 204 of FIG. 4 has been eliminated to show yet another embodiment of the feed stages of the machine.

In application of the machine to high volume instrument HVI cotton classing, it has been found that the condition of the fiber influences the results. Moisture content, static charge, and state of relaxation materially affect only only the foreign matter removal efficiency and fiber damage of the machine, but subsequent other fiber property measurements as length and strength as well. These findings are equally applicable to processing machinery applications.

A most important consequence of the counterflow slot design as embodied for example in FIG. 5 results. The air or other transport gas fed into the machine at the counterflow slots 304, 306, 308 and at the inlets 309 and 311 may be controlled in its humidity and electrostatic charge quality so that the operation of the aeromechanical release and separation means can be on preferred states of the fiber with regard to humidity and static charge. That is, the air into the machine can be far more economically and accurately conditioned than the entire air in the work space, thus providing fundamental advantages for measurement and processing. It is furthermore clear that the humidity and electrostatic charge of the fiber may be different at each of the different processing stages simply by controlling the air fed into the system at the various counterflow slot points.

The physical state of the fiber presented at 320 to the Microdust and Trash Machine has proven to be of similar fundamental importance with regard to foreign matter release, processing speed, and fiber damage. Thus in FIG. 5 a perforated belt-feed system 330 draws 332 conditioned air 334 through the feed table 336.

Yet another physical property, the state of relaxation of the fiber, has proven important in MTM processing. Fiber from tightly compressed bales can be relaxed by first plucking small tufts from the mass and then transporting them to the feed table 336 of FIG. 5. This may also be easily done by replacing the feed table with a standard condenser which is well known in the art. Obviously, the air drawn into the condenser may be similarly conditioned as at 336 in FIG. 5. The fibers can be given preferential alignment and can be deposited in a more blended, more uniform mat.

Figure 6A:
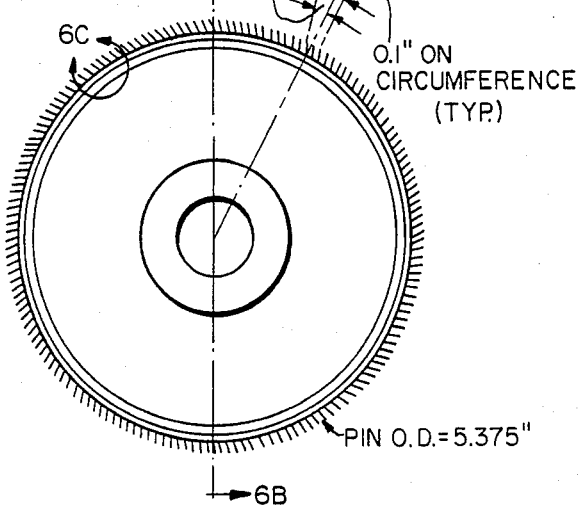
FIG. 6A is an end view of a typical perforated and pinned cylindrical wheel in accordance with the invention.
Figure 6C:
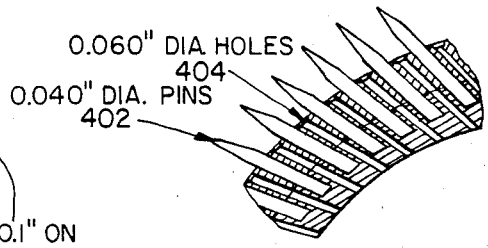
FIG. 6C is a greatly enlarged view of a portion of the circumference of the wheel of FIG. 6A.
Figure 6B:
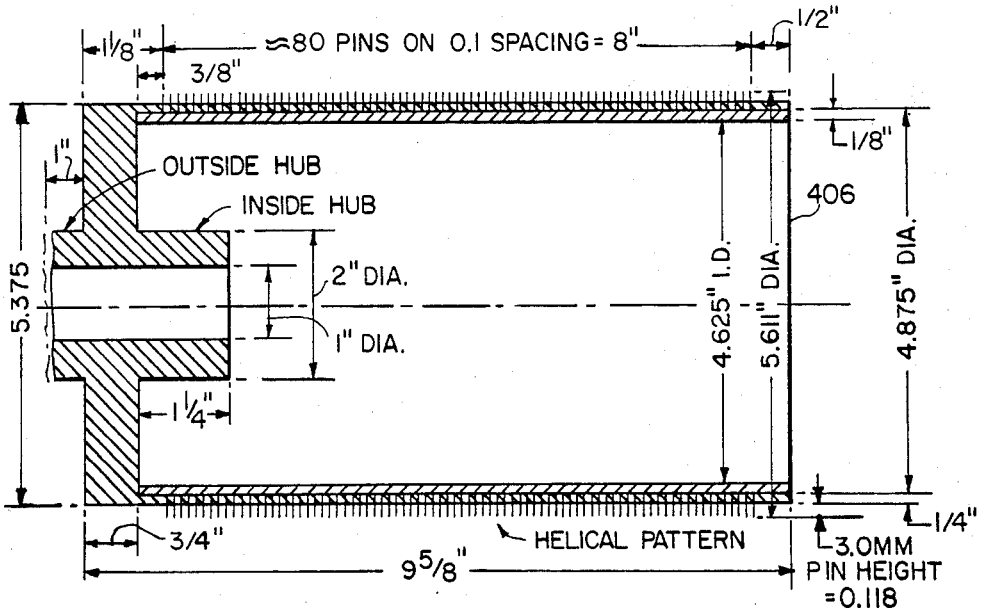
FIG. 6B is a longitudinal section along line 6B—6B of FIG. 6A.

FIGS. 6A, 6B and 6C show in detail a typical perforated cylinder in accordance with the invention, and the method by which air is drawn into the perforated cylinder. FIG. 6C in particular illustrates the arrangement of the pins 402 and the perforation holes 404. Air is drawn into the holes 404 by a cylindrical blocking sleeve which slips into from the cylinder right-hand end as seen in FIG. 6B. (FIG. 5 shows an end view of the blocking sleeve 34.) The blocking sleeve axial slots cut at the preferred circumferential locations and draw microdust-laden air in, as in FIG. 4 (at 218, 230) or FIG. 5 (at 342, 344, 346). Air is drawn out of the cylinder by any suitable means.

Reconsidering FIG. 4 in light of FIG. 6 it may be noted that microdust-laden air 218, 230 is transported out of the internal parts of the main cylinder 212 and blocking sleeve 220 as described above and into a single pipe. Similarly, the flow for the five counterflow separation slots of FIG. 4 may be either individually transported into measurement apparatus, such as electro-optical sensors 44, 64 illustrated in FIG. 1 or, may be combined into a single counduit 60. The individual flows $Q_s$ for the five slots in FIG. 4 are adjusted simply by providing variable restrictions in the flow lines, as is well known in the art.

Combining all of the dust plus trash thus released and separated by the MTM provides yet another meritorious use of electro-optical sensing. Since it is desired to know the relative amounts of dust (50 $\mu$m to 500 $\mu$m AED) and trash (>500 $\mu$m AED), the electro-optical sensing means may be used to provide characterization of these components. Still further, the modified CAM sensor permits mass function resolution into perhaps eight sized channels, beginning at 50 $\mu$m.

The point of this observation is that the aeromechanical separator of FIG. 4 basically has one, sharply-defined but point at AED 50 $\mu$m. This is a simplification and in some measures an improvement over the embodiment of FIG. 1 where trash, dust and microdust all are aerodynamically defined. The requisite resolution of the dust and/or trash components is in this embodiment is advantageously performed with electro-optical measures.

It is also noted that the common dust plus trash catch may be subsequently analyzed by other methods such as sieve analysis, cascade impaction, and the like. However, these gravimetric means are not easily amenable to high-speed measurements required for high volume instrument testing purposes.

As a final observation, it is noted from FIG. 1 that the cleaned, blended, and processed fiber 96 is pneumatically transported away from the MTM. It will be appreciated that additional fiber property measurements may be advantageously made with electro-optical means. These fiber parameters include the lint feed rate, the fiber diameter distribution, which relates to maturity and fineness, and the length distribution, which is an important parameter determining the yarn properties, especially strength. From the length distribution one may determine the conventional specifications such as 2-½% span length, upper-half mean, or short fiber content of the fibers. Short fiber content, for example, the percentage weight below ½" in fiber length, is of significant importance currently because of the excessive ginning required to clean cotton harvested by the stripper method. This equipment entrains much more foreign matter into the seed cotton than prior harvesting methods. It is believed that increasing short fiber content is currently resulting in poorer quality yarn and less economical preparation thereof.

It will be appreciated that still other fiber parameters may obviously be made electro-optically in the state illustrated in FIG. 1 or perhaps in a condensed state. These include color and nep content. (Neps are small ball-like entaglements of fiber that ultimately appear as yarn or cloth imperfections.) The pnuematic transported state of FIG. 1 is preferentially ideal for identification of neps.

In summary, the more conceptual methods and apparatus of FIGS. 1–3 and the preferred embodiments of FIGS. 4–6 teach a new method for removing foreign matter from lint. It is emphasized again that the teachings of this invention or extensions thereof are equally applicable to measurements of foreign matter and to its removal for improved processing purposes. It is envisioned for the latter application that higher speed, more efficient, and less damaging lint cleaning and other processing machinery can now evolve based on the principles of these teachings.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. Apparatus for removing foreign matter from bulk fiber material, said apparatus comprising:

a perforated cylindrical rotating beater wheel having perforations for permitting radially inward airflow and having projections for engaging fibers on said beater wheel, the perforations being sufficiently small to substantially preclude movement of lint through the perforations;

a mechanism for continuously supplying bulk fiber material to said beater wheel at a first point along the rotational path thereof;

a mechanism for continuously removing the lint mat from said beater wheel at a second point along the rotational path thereof; and a port for withdrawing transport gas from the interior of said cylindrical beater wheel to provide aerodynamic force tending to pull fiber and foreign matter towards the cylindrical surface of said beater wheel.

2. Apparatus in accordance with claim 1, which further comprises a blast gas source for directing a radially-inward blast of gas onto said beater wheel at a third point along the rotational path between the first and and second points, the blast of air serving to release and separate microdust from the lint.

3. Apparatus in accordance with claim 1, which comprises means for providing controlled rates of transport gas flow to said cylindrical wheel for a controlled degree of fiber engagement with said wheel as transport gas is drawn into said cylinder through the perforations.

4. Apparatus in accordance with claim 2, which comprises means for providing controlled rates of transport gas flow to said cylindrical wheel for a controlled degree of fiber engagement with said wheel as transport gas is drawn into said cylinder through the perforations.

5. Apparatus in accordance with claim 3, wherein said transport gas is conditioned.

6. Apparatus in accordance with claim 1, which comprises means for directing pulsating unidirectional airflows against the cylindrical beater wheel for causing repeated engagement of fibers with cleaning projections.

7. Apparatus in accordance with claim 1, which comprises means for applying electrostatic force to the fiber and particles.

8. Apparatus in accordance with claim 1, which further comprises a counterflow slot oriented generally tangentially with respect to said beater wheel and positioned with respect to the direction of wheel rotation such that dust and trash particles are thrown by rotational forces into said counterflow slot, and such that transport gas is drawn through said counterflow slot towards and into said cylindrical beater wheel in a direction counter to the direction of thrown dust and trash particles.

9. Apparatus in accordance with claim 8, wherein conditioned transport gas is provided to said counterflow slot.

10. Apparatus in accordance with claim 1, which further comprises means for measuring microdust carried by transport gas drawn through said port from the interior of said cylindrical beater wheel.

11. Apparatus in accordance with claim 8, which further comprises means for measuring particles thrown into said counterflow slot.

12. Apparatus for removing foreign matter from bulk fiber material, said apparatus comprising:

a cylindrical rotating beater wheel having projections for engaging fibers on said beater wheel;

a mechanism for continuously supplying bulk fiber material to said beater wheel at a first point along the rotational path thereof;

a mechanism for continuously removing the lint mat from said beater wheel at a second point along the rotational path thereof;

a counterflow slot oriented generally tangentially with respect to said beater wheel and positioned with respect to the direction of wheel rotation, such that dust and trash particles are thrown by rotational force into said counterflow slot; and means for drawing transport gas through said counterflow slot in a direction generally towards said beater wheel and counter to the direction of thrown dust and trash particles.

13. Apparatus in accordance with claim 10, wherein conditioned transport gas is provided to said counterflow slot.

14. Apparatus in accordance with claim 12, which further comprises means for measuring particles thrown into said counter flow slot.

* * * * *